United States Patent [19]

Coons

[11] 4,023,843

[45] May 17, 1977

[54] MAIL HANDLING DEVICE

[76] Inventor: C. Curtis Coons, 794A Via Altos, Laguna Hills, Calif. 92653

[22] Filed: Oct. 6, 1975

[21] Appl. No.: 619,835

[52] U.S. Cl. ..... 294/19 R; 258/3

[51] Int. Cl.[2] ..... A47F 13/06

[58] Field of Search ..... 258/1, 3, 5–8, 258/11, 19, 23, 25, 26; 294/19 R, 22, 104, 116, 99 S; 214/1 M

[56] References Cited

UNITED STATES PATENTS

| | | | |
|---|---|---|---|
| 539,330 | 5/1895 | Ayars | 258/19 |
| 895,307 | 8/1908 | Sappenfield | 258/26 |
| 2,819,110 | 1/1958 | Redmon | 294/19 R |

*Primary Examiner*—Drayton E. Hoffman
*Assistant Examiner*—H. Grant Skaggs
*Attorney, Agent, or Firm*—Sellers and Brace

[57] ABSTRACT

A mail handling device to facilitate the deposit of mail in a public mail box by an occupant of a vehicle. The device has a long handle equipped at one end with a mail gripper operable to deposit the mail into the box as a mail release device engages the receiving chute of the box.

8 Claims, 5 Drawing Figures

MAIL HANDLING DEVICE

This invention relates to paper handling equipment, and more particularly to a simple inexpensive device for handling and depositing envelopes and the like mailing pieces in a public curbside mail box by the occupant of a vehicle while stopped beside the box.

It is a frustrating experience to attempt the deposit of one or more letters in a public mail box of the type mounted at curbside and provided with a mail receiving chute intended to facilitate the receipt of mail by a motorist without need for leaving his vehicle. Not infrequently such attempts are unsuccessful, or result in injury to the person or his clothing or in dropping one or more pieces of mail in the gutter. A contributing factor to the difficulty is the fact that the bottom wall of the receiving chute slopes outwardly and downwardly to safeguard against the entry of rain water and snow and therefore necessitates releasing the mail only after it has been thrust well into the chute.

Accordingly, it is a primary purpose of the present invention to provide a simple compactly-collapsible tool readily storable in a minimum of space in a passenger vehicle and provided with gripping means at one end for firmly gripping and retaining one or more pieces of mail therein while being extended well into the inlet chute of a mail box and including means under the control of the operator for releasing the mail for gravity to pull the mail into the interior of the box.

Another object of the invention is the provision of a highly reliable lightweight mail handling device provided with an extendable handle and having means for firmly gripping mail while being deposited in a curbside mail box by a person seated in a motor vehicle.

Another object of the invention is the provision of mail handling tong-like tool for holding either a single or a packet of mailing pieces while being deposited in the receiving chute of a curbside mail box and provided with release means engageable upon contact with the chute edge to release the mailing pieces into the box.

These and other more specific objects will appear upon reading the following specification and claims and upon considering in connection therewith the attached drawing to which they relate.

Referring now to the drawing in which a preferred embodiment of the invention is illustrated:

Figure 1:
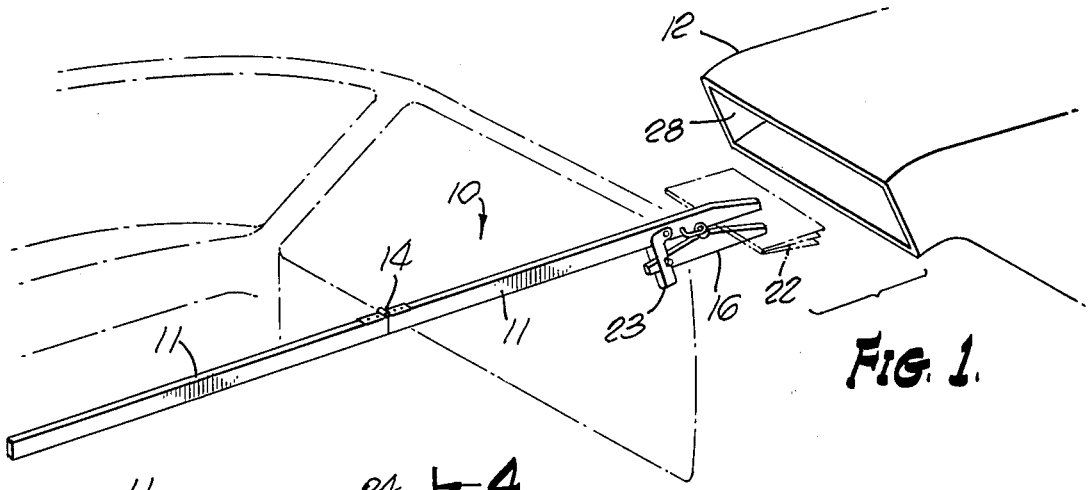
FIG. 1 is a generally diagrammatic perspective view of an illustrative embodiment of the invention mail handling device holding several mailing pieces while approaching the entrance end of a mail box chute.

Referring initially more particularly to FIG. 1, there is shown one preferred embodiment of the invention mail handling device, designated generally 10, comprising a long lightweight handle 11 of sufficient length to permit an occupant of a vehicle to deposit mailing pieces into the inlet chute 12 of a curbside mail box. As here shown by way of example, the midlength of handle 11 is provided with a hinge 14 mounted either on the side or across the top edge of the handle thereby permitting the handle to be folded against the front end when not in use. The hinge may include a suitable spring, such as a torsion spring, effective to hold the handle in its fully extended position when not held collapsed against the forward end by a suitable retaining clip, rubber band or the like. If the hinge is mounted crosswise of the upper edge of the handle, the handle is automatically held open when held with its top edge uppermost. Handle 11 may be made of any suitable material such as wood, plastic, tubing, etc.

Figure 2:
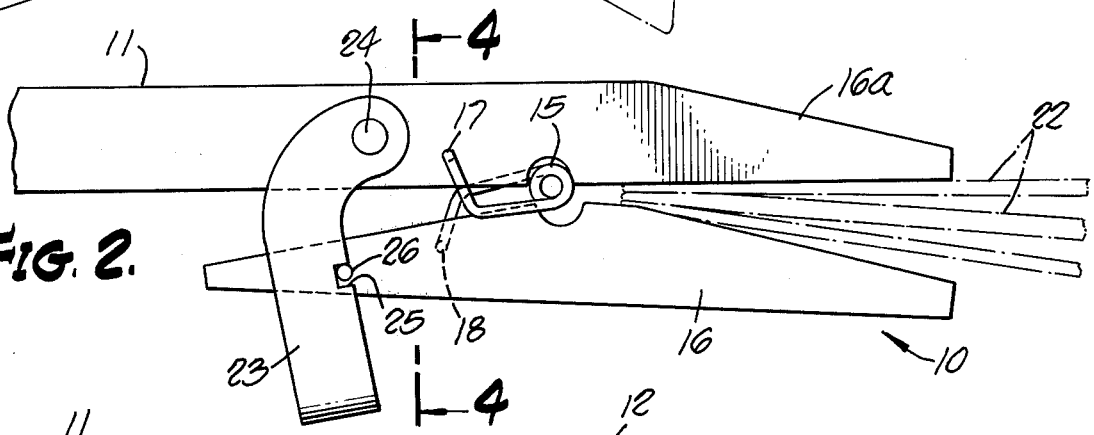
FIG. 2 is a fragmentary side view on an enlarged scale of the front end of the device shown in FIG. 1.
Figure 5:
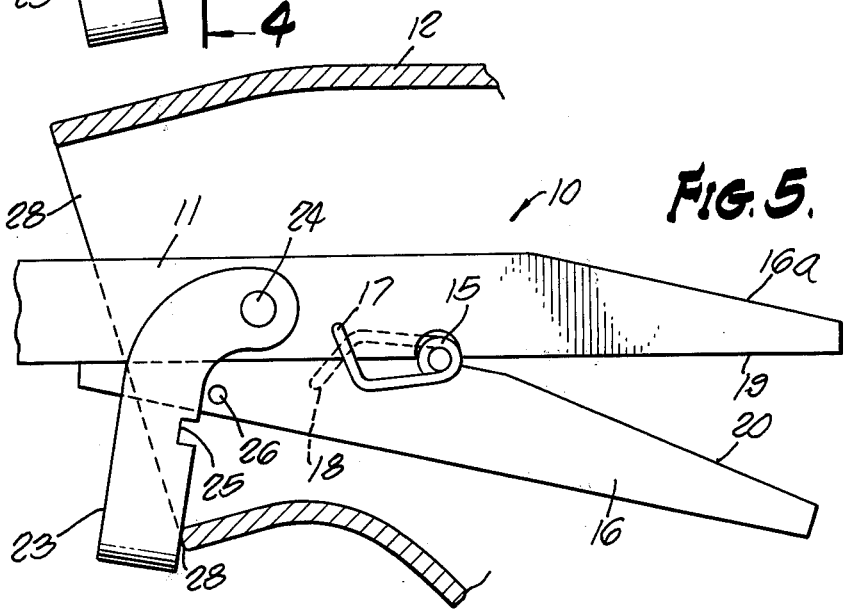
FIG. 5 is a fragmentary cross-sectional view of the mail handling device as viewed a moment after releasing mail into the mail box.
Figure 3:
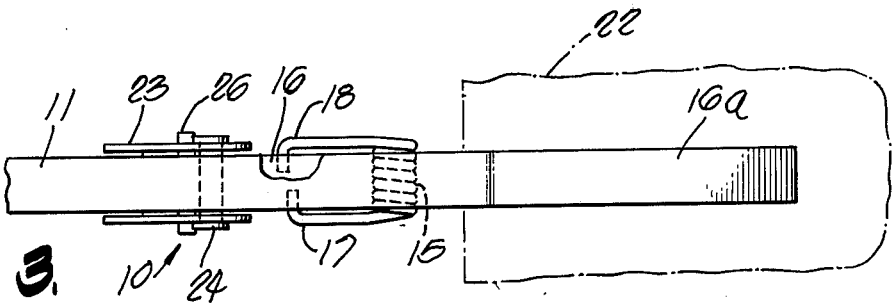
FIG. 3 is a top plan view on a reduced scale of FIG. 2.

Hingedly connected to the forward end of handle 11 by torsion spring 15 is a gripper jaw 16 shaped as best shown in FIGS. 2 and 5. One end 17 of the spring is anchored in a hole through handle 11 whereas the other end 18 is inserted in a similar hole in jaw 16. Ends 17, 18 of the coil spring 15 are connected to the handle and to the pivoting jaw substantially rearwardly of the coil axis and are therefore effective to bias the left hand end of jaw 16 as viewed in FIG. 5 firmly against the adjacent underside of handle 11. In this position the forward end of jaw 16 is open to a generally maximum degree and the mail held between the jaws will slip out into the mail box chute.

Figure 4:
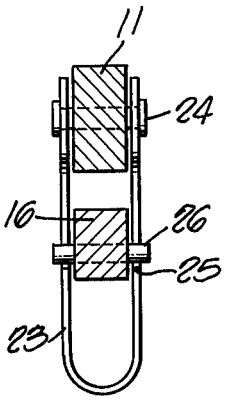
FIG. 4 is a cross-sectional view taken along line 4—4 on FIG. 2.

In using the device, the operator grasps the forward ends of the two jaws **16, 16*a* between the thumb and fingers and pinches them together thereby pivoting jaw 16 counterclockwise about the pivot provided by spring 15 so that the release trigger 23 can be pivoted counterclockwise about its pivot 24 until its locking notch 25 engages pin 26 in the manner shown in FIG. 2. Owing to the fact that release trigger 23 is generally of inverted L-shape and pivoted to handle 11 on pivot 24 at the forward end of its shorter leg as viewed in FIGS. 2 and 4, it will be apparent that the trigger is gravity biased to rotate counterclockwise about pivot 24 when the tool handle is supported generally horizontally. In consequence, stop 26 will ride along the adjacent edge of release trigger 23 and enter notch 25 automatically as jaw 16 is manually pivoted counterclockwise about the coiled portion of spring 15 while the tool is either held horizontally or with its forward end inclined downwardly from a horizontal plane. In this position of the jaws the edges 19, 20 form a shallow V-notch of minimum width into which mailing pieces may be pressed until firmly wedged between the innermost ends of surfaces 19 and 20, closely adjacent the coil of spring 15. This inner end of the receiving notch is sufficiently narrow to grip a single or several pieces of mail. If a thick packet or several pieces of mail are inserted as is indicated at 22 in FIGS. 1 and 2, these may cause jaw 16 to shift bodily away from handle 11 as is clearly indicated in FIG. 2**. In this position the spring remains highly effective in causing the jaws to grip the multiple pieces of mail and retaining them firmly captive while being deposited.

One or more mailing pieces are thrust edgewise between the jaws until gripped very positively and firmly therebetween. The operator then manipulates the device from a seated position in the vehicle so as to insert the mailing pieces into the entrance 28 of the mailing chute 12. The device is so manipulated that the release trigger means 23 engages the bottom edge of the chute inlet thereby pivoting the trigger clockwise about pivot 24 to a release pin stop 26 from notch 25 whereupon spring 15 snaps jaw 16 downward opening the V-notch to a maximum allowing the mailing pieces into the mail box chute. The device is then withdrawn and the gripping end of handle 11 is folded against its forward end for storage on the vehicle cowl or in the glove compartment.

While the particular mail handling device herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

I claim:

1. A hand-held mail handling tool for depositing mail in a curbside mailbox by a person seated in a vehicle stopped opposite the mail receiving opening of the mailbox, said tool comprising a long handle having a pair of spring biased pivotally connected jaw members at the forward end thereof for gripping and supporting flat mailing pieces in a horizontal plane generally coplanar with said handle as the user thrusts said tool and mailing pieces gripped therein forwardly lengthwise of said handle into the mail receiving opening of a mailbox, said jaw members including a release member which is pivotally mounted to one of said jaw members and engageable with stop means on the other jaw member to retain said jaw members in a mail-gripping closed position, said release member being engageable with a part of the mail box as the user of said hand-held tool thrusts said mail gripping jaw members forwardly through the mail receiving opening of a mailbox and operable by said engagement to release the mailing pieces for deposit by gravitation into the mailbox.

2. A mail handling tool as defined in claim 1 characterized in that said tool handle is formed in two parts extendable into alignment with one another when in use and collapsible to lie side by side when not in use.

3. A mail handling tool as defined in claim 1 characterized in that said tool handle is formed in two parts and includes means for holding said parts coupled together in alignment when in use and collapsible for compact stowage when not in use.

4. A mailing handling tool as defined in claim 1 characterized in that one of said jaw members is integral with the forward end of said handle, and the other of said jaw member is positioned beside one edge of said one jaw member, and said biasing spring pivotally interconnecting and holding said jaw members biased into a position to grip mail therebetween when said release member is engaged with said stop means.

5. A hand-held tool for depositing mail in a curbside mail box by a person seated in a non-moving vehicle comprising: a long handle having a pair of jaws movable relative to one another projecting forwardly from the forward end thereof and including spring hinge means biasing said jaws to an open mail-releasing position and operable to grip a packet of flat mail and hold the same in a generally horizontal plane while said handheld tool is thrust forwardly lengthwise of said handle into a mailbox opening lying in a plane extending crosswise of said handle, stop means on one of said jaws, release means on the other of said jaws engageable with said stop means and thereby operable to stress said spring means and hold said release means in position to grip mail therebetween, and said latch means being engageable with an edge portion of a mailbox opening as said tool is thrust forwardly thereinto to release said jaws from said stop means and permit a mail packet gripped therebetween to drop into the mailbox.

6. A tool as defined in claim 5 characterized in that said spring hinge means is adapted to accommodate said jaws to grip firmly and reliably both a relatively thick and a relatively thin packet of mail.

7. A tool as defined in claim 5 characterized in that the adjacent mail gripping edges of said jaws diverge from one another in both the open and in the mail gripping positions thereof and wherein the angle of divergence is small at all times but smaller in the mail gripping position than in the normal open position thereof.

8. A tool as defined in claim 5 characterized in that said release means is biased by gravity toward a position to latch said jaws in a mail gripping position when said tool is held in a generally horizontal plane with said release means extending downwardly from a pivotal support therefor on said handle.

* * * * *

UNITED STATES PATENT AND TRADEMARK OFFICE

CERTIFICATE OF CORRECTION

PATENT NO. : 4,023,843

DATED : May 17, 1977

INVENTOR(S) : C. Curtis Coons

It is certified that error appears in the above-identified patent and that said Letters Patent are hereby corrected as shown below:

Column 4, line 1, "member" should be --members--;

line 2, "said biasing spring" should be --a biasing spring--;

lines 19-21, delete "release means . . . said latch means" and insert therefor --jaws in position to grip mail therebetween, and said release means--;

line 23, delete "jaws" and insert therefor --release means--.

Signed and Sealed this

*sixteenth* Day of *August 1977*

[SEAL]

*Attest:*

RUTH C. MASON
*Attesting Officer*

C. MARSHALL DANN
*Commissioner of Patents and Trademarks*